United States Patent [19]

Hasselmann et al.

[11] Patent Number: 4,565,352

[45] Date of Patent: Jan. 21, 1986

[54] WINCH DRIVE

[75] Inventors: Heinz Hasselmann, Hagen-Emst; Volkmar Kunze, Wetter; Harald Bitsch, Witten, all of Fed. Rep. of Germany

[73] Assignee: Mannesmann Aktiengesellschaft, Duesseldorf, Fed. Rep. of Germany

[21] Appl. No.: 538,951

[22] Filed: Oct. 4, 1983

[30] Foreign Application Priority Data

Oct. 30, 1982 [DE] Fed. Rep. of Germany ..... 3240345

[51] Int. Cl.[4] ..... B66D 1/22; B66F 3/00

[52] U.S. Cl. ..... 254/344; 254/219

[58] Field of Search ..... 254/344, 297, 219, 342

[56] References Cited

U.S. PATENT DOCUMENTS

| | | | |
|---|---|---|---|
| 2,448,674 | 9/1948 | Lawler | 254/297 X |
| 2,552,859 | 5/1951 | Nardone | 254/344 |
| 2,891,767 | 6/1959 | Armington | 254/344 |
| 2,966,068 | 12/1960 | Christian | 254/344 X |
| 3,071,349 | 1/1963 | Glaze | 254/344 |

FOREIGN PATENT DOCUMENTS

| | | | |
|---|---|---|---|
| 1962734 | 6/1971 | Fed. Rep. of Germany | 254/344 |
| 2259338 | 6/1973 | Fed. Rep. of Germany | 254/344 |
| 2304370 | 8/1974 | Fed. Rep. of Germany | 254/344 |
| 3042479 | 5/1982 | Fed. Rep. of Germany | 254/344 |

*Primary Examiner*—Stuart S. Levy
*Assistant Examiner*—Joseph J. Hail
*Attorney, Agent, or Firm*—Ralf H. Siegemund

[57] ABSTRACT

A motor with output shaft is coupled to an input shaft of a planetary gear system inside a case which in turn is disposed in the winch drive. The output shaft of the transmission gear traverses the other end of the case and is connected to a web plate of the winch drum by means of a spline shaft. On one end of the winch drum, the casing for the transmission gear and the shield of the motor are interconnected and connected to a principle frame and the winch drum is journaled thereat through roller bearings using cylindrical surfaces of the case and the drum directly as races. The winch drum is journaled at the other end through appropriate bearings in the principle carrier frame.

10 Claims, 4 Drawing Figures

WINCH DRIVE

BACKGROUND OF THE INVENTION

The present invention relates to a winch drive with an internally arranged planet gear and a motor for driving the winch drum being secured to the frame at one front end of the drum and wherein the drive shaft of the motor is drivingly connected to the driven input of the planet gear.

German printed patent application No. 3,042,479 discloses basically a winch drum of the type to which the invention pertains. The particular construction shown in that publication is disadvantaged by the fact that the driven input for the gear is run through hollow shafts to the side opposite the motor. Hollow drive shafts are needlessly expensive as compared with regular shafts and comparable gear ratios lead to a larger diameter of the gear so that planetary gears of this type are not always ameanable to be installed in conventional winch drums.

For economic reasons, winch drums should not have a diameter larger than is required in accordance with industry standards (see for example DIN No. 15020, FEM 9.661). If the winch drums have to be constructed with a, relatively speaking, larger diameter than necessary simply because the transmission gear has a large diameter the load on the gear as far as torque is concerned is inevitably higher and that in turn may require a larger speed reducing ratio under the assumption that the hub speed remains the same.

Another disadvantage of the arrangement shown in the above identified printed patent application is to be seen in that the combination, motor-transmission-clutch has to be arranged outside of the drum web and, therefore, requires appreciably more mounting space. In the case of compact lifting devices, this is another significant drawback.

DESCRIPTION OF THE INVENTION

It is an object of the present invention to provide a new and improved construction concerning the insertion of a planetary gear transmission into a winch drum such that the aforementioned difficulties are avoided and particularly needlessly expensive components should not be used, while on the other hand the principle should be applicable also to small winch drums.

It is a specific object of the present invention to improve winch drives which include a winch drum, a planetary transmission gear disposed in the drum, and a particular housing, the transmission gear being provided with input and output shafts are further including a motor having a shaft arranged at one axial end of the drum.

In accordance with the preferred embodiment of the present invention, it is suggested to improve the arrangement as per the specific object by connecting the drive shaft of the motor to the input shaft of the gear while the output shaft of the planetary gear is oriented towards the respective other axial end of the drum; and web plate is secured to that other end of the drum and the output shaft of the planetary gear is drivingly connected to the web plate to thereby impart rotation upon the drum. It can thus be seen that the inventive combination does not require extensive and expensive hollow shafts and the sun gears of the planetary transmission gear system have a small diameter and engage the respective planet gears whereby the planet gears of the output stage are connected to the output shaft of the transmission gear as a whole through the planet gear carrier. The short steps of the gear system will not exhibit torsions oscillations as they frequently occur in prior art devices. Moreover, a winch drum of conventional length may be provided with more than one cascaded planetary gear stages. The rather compact construction permits the transmission of large torques and selective speed reductions of small or large values even if the drum diameter is comparatively small.

In furtherance of the invention, a mounting shield of the motor is provided for partial insertion in the winch drum and a coupling or clutch is provided for establishing the connection of the motor shaft with the input shaft of the transmission here. The output shaft of the transmission gear as a whole, i.e., of the last stage thereof, is secured against axial displacement in relation to the cover of the transmission gear casing. That cover may be removably threaded or bolted to the cylindrical part of the case for ease of assembly and disassembly of the transmission gear. The output shaft of the transmission gear may be connected to the aforementioned web plate by means of a spline shaft. Inclusion of such a spline shaft is not essential in principle, but a practical matter in order to accommodate basic units such as the transmission and the motor to differently deep winch drums. The spline shaft itself is appropriately secured against axial displacement. The web plate is suitably disposed between the one end of the winch drum itself and the internal housing or casing for the planetary gear.

The web plate includes a bearing by means of which the winch drum is journaled in a frame under conditions which prevent axial displacement. Roller bearings support the other end of the winch drum, i.e., the end adjacent to the motor. This roller bearing is particularly interposed between the casing of the planetary gear and the winch drum proper. This journal bearing, has a large diameter so that it does not really have to meet particular critical condition which arise in case the diameter were small. The rollers of the bearing are interposed directly between and internal cylindrical annular faces of the winch drum and an outer annular cylindrical face of the casing for the gear. This establishes journal bearing of very small dimensions so that the casing for the planetary gear or gear system can be inserted in the winch drum without wasting valuable mounting space inside the winch drum.

The motor casing of the planetary gear system and a part of the mounting frame for the system as a whole are bolted together in the area adjacent the drum end at the motor drive side so that the drum as well as the casing of the planetary gear are supported at that frame structure, the drum of course, being indirectly supported through the above mentioned roller bearings. The case for the planetary gear should be sealed in relation to the remainder of the system including particularly the interior at large of the drum in order to avoid soiling of the interior of the drum, for example through bearing grease or the like.

The inventive arrangement permits utilization of single planetary gear as well as multiple cascading, such as for example a five stage cascaded planetary transmission gear system so that the overall drive system can be adapted to the specific requirements as to rotational speed and/or torque for the winch drum. The connection between transmission gear and motor should be generally of a variable nature such that different motor sizes can be used including also a variety of motors such as a synchronous motor; squirrel cage type induction motors; D.C. motors; slippring motors or explosion proot motors can all be used and the system is readily adaptable to either type.

The configuration for the bearings have been chosen so that no bending moments or only very minor bending moments will occur in lateral flanges as well as in the basic support frame. The gear transmission is designed so that the various planetary stages are rated corresponding to the size of the drum and in accordance with steps as it relates to the load so that particularly the planetary stages become reusable.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

DETAILED DESCRIPTION OF THE DRAWINGS

Figure 1:
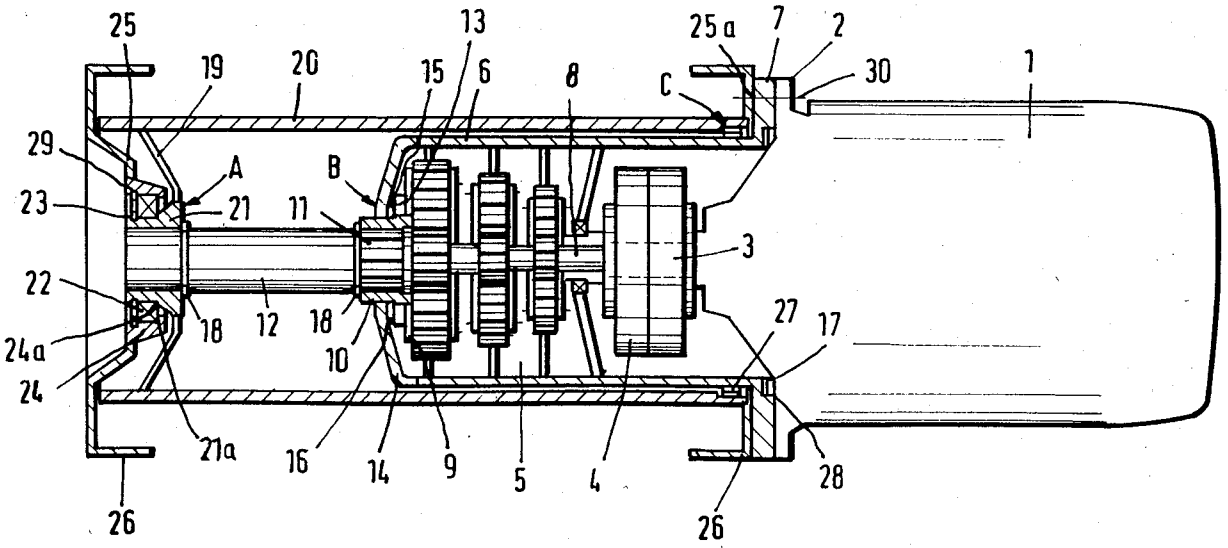
FIG. 1 is a longitudinal section view through a winch drum with transmission gear motor and coupling all in accorance with the preferred embodiment of the present invention for practicing the best mode thereof.

FIG. 1 illustrates a motor 1 having an output shaft 3 and a clutch or coupling 4 for purposes of connecting the solid shaft 3 to a planetary transmission gearing 5. The gearing 5 is arranged inside a housing or case 6 which in turn is arranged inside a winch drum 20. The housing or casing 6 is provided with a flange 7 against which bears the motor shield 2, which is traversed by and supports the output shaft 3.

Figure 2:
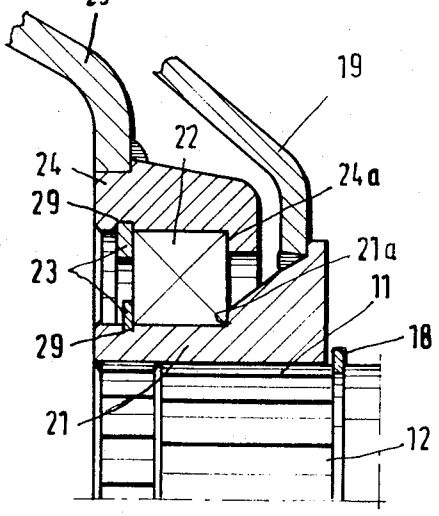

The shield 2 and the flange 7 are secured by means of bolts 30 to the front plate 25*a* of a carrier frame 26. The frame 26 is provided at its end, opposite motor 1, with a recessed front plate 25 which in turn carries a ring or annulus 24 for a bearing 22 (see FIG. 2). A web element 19 of the winch drum is welded to and supported by the bearing ring 21 in that bearing 22. Annulus 24 and bearing ring 21 are respectively provided with annular abutment surfaces 24*a* and 21*a* serving as axial stops for bearing 22. Moreover, the rings 21 and 24 are provided with annular grooves 29 respectively for insertion of clamping and locking rings 23 for axially positioning of the bearing 22 so that the bearing 22 remains in position. It can thus be seen that the winch drum is journaled to frame parts 25 and 26 at the end opposite motor 1.

Figure 4:
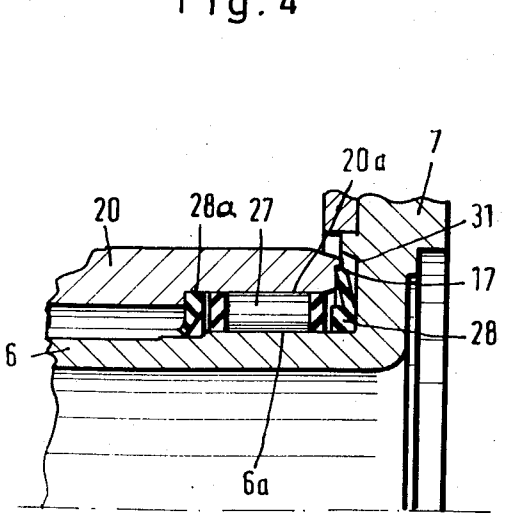
FIGS. 2, 3 and 4 are cross-sections on an enlarged scale and of details respectively identified by A, B, and C in FIG. 1.

The winch drum 20 is supported indirectly on the frame 26 on the side of the motor by means of a supporting bearing through the flange 7 of casing 6 of the planetary transmission gearing 5. The casing is bolted to frame 26. Case or housing 6 as well as winch drum 20 are respectively provided with finished annular surfaces serving directly as races. These include external surface 6*a* and internal annular surface 20*a* respectively for engagement by the rolls 27 of the particular bearing by means of which the winch drum is rotatably supported in a manner outlined above. Moreover, a sealing lip 28 is inserted in an annular groove for sealing the interior of the winch drum. The lip 28 slidingly engages the front face 17 of the drum 20. A further sealing lip 28*a* protects the rolls 27 on the side opposite sealing lip 28. These details are shown in FIG. 4.

Figure 3:
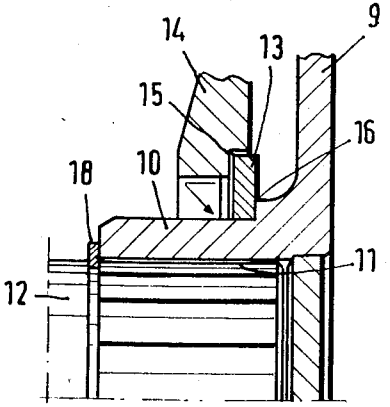

A transmission shaft 12 is provided with teeth 11 at its ends in spline shaft fashion and transmitts the torque from the output shaft 10 of the last stage of the planetary transmission gear to the bearing ring 21 and the recessed web 19 to the winch drum 20 (FIG. 3). A cover 14 of the housing 6 is provided with an annular surface 15 for abutment with a disc 13 against which bears the output shaft 10 of the planet carrier 9 of the planetary output stage under utilization of a disc shaped stop 16. This feature is also shown in greater detail in FIG. 3. Clamping and locking rings 18 are inserted in the transmission shaft 12 and limit any axial displacement of the transmission shaft 12 as between the shaft 10 and the bearing ring 21.

Shaft 10 has a blind bore end with internal teeth for engagement with the teeth of spline shaft 12. Shaft 12 is not essential in principle, but is used to adapt the axial length of the transmission gear, being a constructural unit, to the length of the winch drum. The latter length varies for different cases, but the transmission should be standardized for different applications. This shaft 12 serves as a length adaptor.

The invention is not limited to the embodiments described above, but all changes and modifications thereof not constituting departures from the spirit and scope of the invention are intended to be included.

We claim:

1. A winch drive including a winch drum, a planetary transmission gear in the drum having input and output shafts, and a motor having a drive shaft arranged at one axial end of the drum, the improvement comprising:

a stationary casing for the transmission gear projecting into the drum;

roller means in direct engagement with an end portion for journalling the drum directly on one end of said casing itself;

coupling means for connecting the drive shaft of the motor to the input shaft of the transmission gear inside said casing;

the output shaft of the planetary gear being oriented towards the respective other axial end of the drum(s);

a web plate disposed and secured to the drum adjacent its other end, and being spaced axially from the casing;

means for connecting the output shaft of the planetary gear to the web plate for providing rotation upon the drum, said output shaft traversing said web plate; and bearing means disposed adjacent said web plate for journalling the exterior end of said output shaft beyond where it traverses said web plate, said bearing means holding the output shaft against axial displacement.

2. A winch drive as in claim 1, wherein the coupling means for connecting are interposed between the planetary transmission gear and a bearing shield of the motor.

3. A winch drum as in claim 1, said case having a cover, the output shaft of the planetary transmission gear being held against axial displacement in relation to said cover.

4. A winch drive as in claim 1, wherein the means for connecting the output shaft to the web plate include a spline shaft.

5. A winch drive as in claim 4, the web plate being arranged between an end of the casing and the respective other end of the winch drum.

6. A winch drive as in claim 1, wherein said bearing means is provided to prevent said axial displacement through annular abutment surfaces and inserted clamping rings.

7. A winch drive as in claim 1, said roller means interposed between the winch drum and a casing for the planetary transmission gear at the drum end facing the motor.

8. A winch drum as in claim 7, wherein said roller means includes rolls interposed directly between a cylindrical annular face of the winch drum and an outer cylindrical annular face of the case.

9. A winch drum as in claim 1, the transmission as being contained in said case, said case having a flange abutting a motor flange and together they are bolted to a front plate of a carrier frame for the entire arrangement.

10. A winch drive as in claim 9, and including sealing means for sealing the case against the drum.

* * * * *